US009011211B2

(12) United States Patent
Zyniecki

(10) Patent No.: US 9,011,211 B2
(45) Date of Patent: Apr. 21, 2015

(54) SANDPAPER AND METHOD OF USE THEREOF

(76) Inventor: Christian T. Zyniecki, Warrensburg, NY (US)

( * ) Notice: Subject to any disclaimer, the term of this patent is extended or adjusted under 35 U.S.C. 154(b) by 859 days.

(21) Appl. No.: 12/748,583

(22) Filed: Mar. 29, 2010

(65) Prior Publication Data

US 2011/0237165 A1 Sep. 29, 2011

(51) Int. Cl.

| | |
|---|---|
| ***B24D 11/00*** | (2006.01) |
| ***B24B 7/18*** | (2006.01) |
| ***B24D 11/04*** | (2006.01) |

(52) U.S. Cl.

CPC ..... *B24B 7/188* (2013.01); *B24D 11/04* (2013.01)

(58) Field of Classification Search

USPC ..... 451/57, 529, 530, 533, 534, 527, 539, 451/548

See application file for complete search history.

(56) References Cited

U.S. PATENT DOCUMENTS

| | | | |
|---|---|---|---|
| 449,930 | A | 4/1891 | Dubey |
| 875,936 | A | 1/1908 | Landis |
| 3,621,615 | A | 11/1971 | Ottinger |
| 4,565,034 | A | 1/1986 | Sekiya |
| 4,644,703 | A | 2/1987 | Kaczmarek et al. |
| 5,645,471 | A | 7/1997 | Strecker |
| 6,080,215 | A | 6/2000 | Stubbs et al. |
| 6,277,160 | B1 | 8/2001 | Stubbs et al. |
| 6,752,700 | B2 | 6/2004 | Duescher |
| 6,960,123 | B2 | 11/2005 | Mitarai |
| 7,004,823 | B2 | 2/2006 | Kisboll et al. |

FOREIGN PATENT DOCUMENTS

| | | | |
|---|---|---|---|
| DE | 102004033537 | A1 | 2/2006 |
| FR | 2699417 | A1 | 6/1994 |
| JP | 6278042 | A | 10/1994 |
| JP | 2006289592 | A | 10/2006 |
| JP | 2008100289 | A | 5/2008 |
| JP | 2008188743 | A | 8/2008 |

*Primary Examiner* — Dung Van Nguyen

(74) *Attorney, Agent, or Firm* — Schmeiser, Olsen & Watts, LLP

(57) ABSTRACT

Disclosed herein is sandpaper that includes a first plurality of particles having a first grain size, the first plurality of particles having a first sanding surface covering a first area of the sandpaper. The sandpaper includes a second plurality of particles having a second grain size that is smaller than the first grain size, the second plurality of particles having a second sanding surface covering a second area of the sandpaper. Further, the sandpaper includes a bonding layer having a back surface located opposite the first sanding surface and second sanding surface and a buffer positioned to raise the second plurality of particles such that the first sanding surface and the second sanding surface of the sandpaper are substantially planar.

15 Claims, 6 Drawing Sheets

SANDPAPER AND METHOD OF USE THEREOF

FIELD OF THE INVENTION

The subject matter disclosed herein relates generally to sandpaper. More particularly, the subject matter relates to a multi-grade sandpaper.

BACKGROUND OF THE INVENTION

Many types of sandpapers are known in the art for sanding and polishing a surface. The "grit" of the sandpaper may determine the smoothness of the finished polish. In the industry, a higher the numerical "grit" value of the sandpaper corresponds with a finer particle size. In order to most efficiently polish or sand a surface, two or more different sandpapers may be used in sequence. For example, lower grit coarser sandpaper may be first applied to a surface for fast removal of material in order to sand the surface down to a relatively smooth state. After the lower grit coarser sandpaper is applied, higher grit finer sandpaper may be applied to polish off the surface to the desired finished state. By first applying the lower grit coarser sandpaper, a significant amount of the higher grit finer sandpaper may be conserved. This is because the higher grit finer sandpaper will be prematurely and quickly ground down and consumed if the surface being sanded is too coarse.

There are many sanding machines and tools for applying sandpaper to sand or polish different surfaces. For example, when sanding or refinishing wood floors, a drum sander is often utilized that includes a belt on which sheet of sandpaper may be applied. To sand a wood floor, an operator will typically install lower grit coarser sandpaper on the drum sander to apply the first stage of sanding. Then the operator will have to take the time to remove this lower grit coarser sandpaper, and install a second higher grit finer sandpaper to finish the job. Of course, this process is would have to be repeated if a third sandpaper grit was required.

Thus, a multi-grade sandpaper and method of use thereof would be well received in the art.

BRIEF DESCRIPTION OF THE INVENTION

According to one aspect of the invention, sandpaper comprises a first plurality of particles having a first grain size, the first plurality of particles having a first sanding surface covering a first area of the sandpaper; a second plurality of particles having a second grain size that is smaller than the first grain size, the second plurality of particles having a second sanding surface covering a second area of the sandpaper; a bonding layer having a back surface located opposite the first sanding surface and second sanding surface; and a buffer positioned to raise the second plurality of particles such that the first sanding surface and the second sanding surface of the sandpaper are substantially planar.

According to another aspect of the invention, sandpaper comprises a bonding layer having a bonding surface and a back surface; a first sandpaper portion having a first grain size attached to the bonding surface of the bonding layer over a first area of the sandpaper; a second sandpaper portion having a second grain size that is smaller than the first grain size, the second sandpaper portion located over a second area of the sandpaper; and a buffer located between the second sandpaper portion and the back surface, the buffer configured to raise the second plurality of particles such that a first sanding surface corresponding to the first sanding portion of the sandpaper and a second sanding surface corresponding to the second sanding portion of the sandpaper are substantially planar.

According to yet another aspect of the invention, a method of sanding a floor comprises attaching sandpaper around a drum of a drum sander, wherein the sandpaper includes a first plurality of particles having a first grain size, and a second plurality of particles having a second grain size that is smaller than the first grain size, wherein the first plurality of particles circumferentially surrounds the drum and extends from a first side of the drum, wherein the second plurality of particles circumferentially surrounds the drum and extends from a second opposing side of the drum; rotating the drum of the drum sander and the attached sandpaper; moving the drum sander along the floor; and sanding the floor with the sandpaper.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
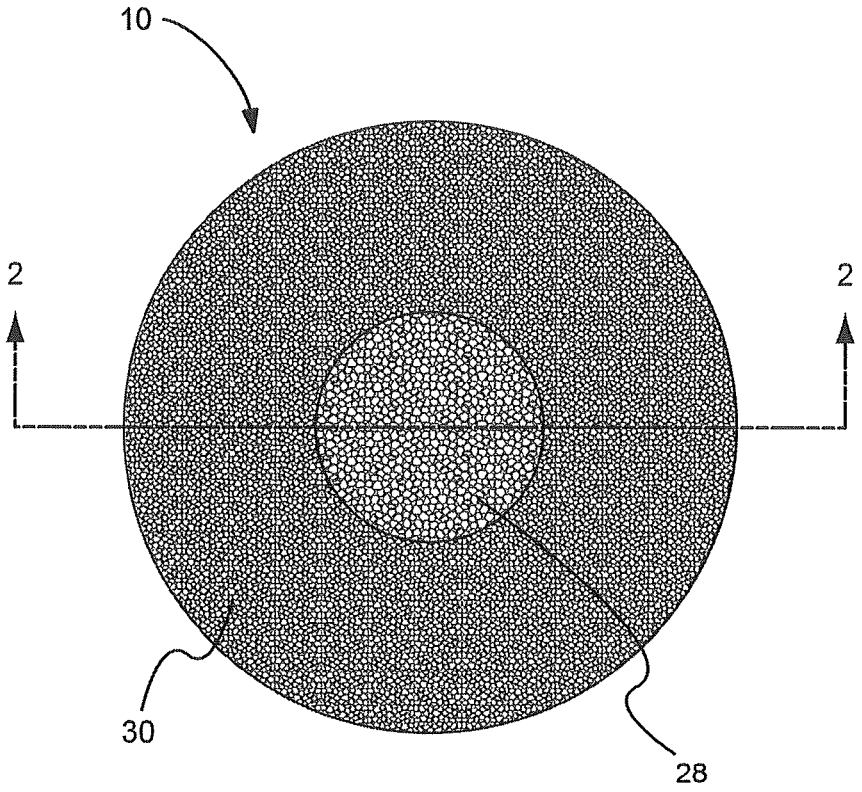
FIG. 1 depicts a top view of a circular sandpaper sheet of sandpaper having a first plurality of particles and a second plurality of particles according to one embodiment of the present invention.
Figure 2:
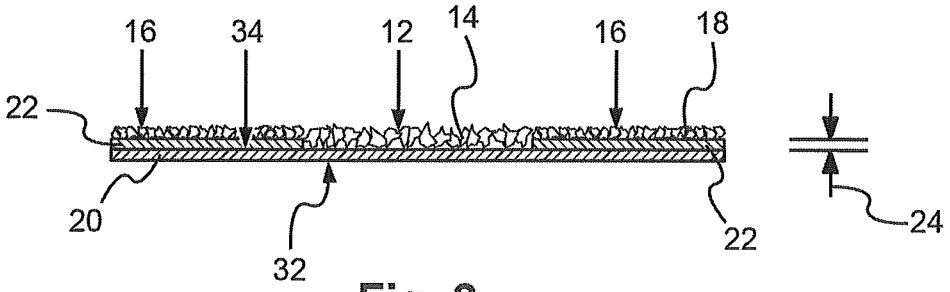
FIG. 2 depicts a cross sectional view of the circular sheet of sandpaper of FIG. 1, taken at arrows 2-2, according to one embodiment of the present invention.

Referring firstly to FIGS. 1 and 2, a circular sheet of sandpaper 10 is shown. FIG. 1 shows a top view of the circular sandpaper 10 sheet while FIG. 2 shows a cross sectional view of the circular sheet of sandpaper 10. The circular sheet of sandpaper 10 includes a first sanding surface 12 that comprises a first plurality of particles 14 and a second sanding surface 16 that includes a second plurality of particles 18. The first plurality of particles 14 have a first grain size or grit, while the second plurality of particles 18 have a second grain size or "grit" that is smaller than the first grain size. The first plurality of particles 14 are attached directly above a bonding layer 20. A buffer layer 22 is located between the bonding layer 20 and the second plurality of particles 18. The buffer layer 22 has a thickness 24 that is configured to raise the second plurality of particles 18 such that the first sanding surface 12 and the second sanding surface 16 are substantially planar. The circular sandpaper sheet 10 is configured to be attachable to a powered rotatable sander (not shown) in order to sand a surface 342 (shown in FIG. 10). The circular sheet of sandpaper 10 provides for simultaneous sanding with two particle grain sizes or grits without requiring a user to change sandpaper sheets, or use two different sanding tools.

The first and second plurality of particles 14, 18 may be made of garnet particles if, for example, the surface to be sanded by the circular sandpaper sheet 10 is wood or a similar material. However, many other particle materials and surfaces to be sanded are contemplated. For example, the particles 14, 18 may also be made of materials such as flint, emery, aluminum oxide, silicon carbide, aluminum zirconia, chromium oxide, ceramic aluminum oxide, and the like. Furthermore, the particles may comprise a combination of materials, such as the materials listed. Thus, depending on the material of particles, and the grit size, the circular sandpaper sheet 10 may be configured to sand or polish a surface of any material such as wood, metal, stone, ceramic, or any other material. It should also be understood that the particles 14, 18 may be stearated, as is commonly known in the art.

The particles 14, 18 may each have a particular "grit" or particle size. The particle size or grit may be measured according to the United States Coated Abrasive Manufacturers Institute (CAMI) scale, as is commonly known in the art. As previously described, the first plurality of particles 14 may have a coarser or larger grain size, corresponding to a lower numbered grit on the CAMI scale. Likewise, the second plurality of particles 18 may have a finer or smaller grain size, corresponding to a higher numbered grit on the CAMI scale. For example, the first plurality of particles 14 may be 40-grit, while the second plurality of particles 18 may be 60-grit. However, it should be understood that any grit size is contemplated. For example, the particles may be 20-grit, 40-grit, 60-grit, 80-grit, 100-grit, 120-grit, 150-grit, 180-grit or 220-grit. The full spectrum of particle sizes is contemplated, comprising particles having an average diameter anywhere equal to or between 8.4 micrometers and 1815 micrometers.

The first sanding surface 12 of the first plurality of particles 14 is shown covering a first area 28 of the circular sandpaper sheet 10, while the second sanding surface 16 of the second plurality of particles 18 is shown covering a second area 30 of the circular sandpaper sheet 10. As shown in the Figures, the first area 28 is an inner circle while the second area 30 is shown circumferentially extending from the first area 28 such that the second area 30 circumferentially surrounds the first area 28. In the embodiment depicted, the coarser particles are located in the first area 28 while the finer particles are located in the second area 30. Furthermore, the second area 30 is shown larger than the first area 28. However, the invention is not limited to this embodiment.

For example, there may be a particular advantage of having the coarser particles in the outer second area 30, with the finer particles being located in the inner circle of the first area 28. It may also be advantageous in an application of the invention for the first area 28 to be larger than the second area 30. Thus, an embodiment may have either of these opposite configurations.

The embodiment depicted in the Figures includes only two particle sizes or grits and two areas 28, 30. Thus, the first plurality of particles 14 and the second plurality of particles 18 cover the entirety of the circular sandpaper sheet 10. However, other embodiments are contemplated that include three or more particle sizes or grits and three or more areas located about the center of the circular sandpaper sheet 10. Moreover, although the first and second areas 28, 30 are shown having circular or substantially circular dimensions, other dimensions are contemplated. For example, the first area 28 may be square, oval, rectangular, triangular, polygonal or any other dimension. In other words, the circular sandpaper sheet 10 is not limited to any of the shape and size dimensions depicted in the Figures.

Whatever the embodiment, the bonding layer 20 is located on the opposite side of the circular sheet 10 of sandpaper than the first and second sanding surfaces 12, 16. The bonding layer 20 may include a back surface 32 and a bonding surface 34. It should be understood that the bonding layer 20 may also be referred to as a backing layer, fastening layer, adhering layer, attaching layer, or the like. In one embodiment, the bonding layer 20 may be made of paper. In other embodiments, the bonding layer 20 may be made of cloth, such as cotton, polyester or rayon. Biaxially-oriented polyethylene terephthalate (PET film), or mylar may be used. Fibers or rubbers may are also contemplated. The bonding layer 20 may also be a waterproof layer. A flexible backing may allow the circular sandpaper sheet 10 to follow irregular rounded contours of a given workpiece; relatively inflexible backing is optimal for regular rounded or plane surfaces. The bonding layer may also be glued to another paper backing layer (not shown) or form a separate support structure for moving sandpaper, such as used in sanding belts and discs. The bonding layer 20 may be stronger such that it may increase the ease of sanding wood. The bonding layer 20 may be hard in order to provide faster sanding. However, the harder the bonding layer 20, the faster the circular sandpaper sheet 10 may wear and the rougher the sanded surface finish.

In the embodiment depicted in FIGS. 1-2, the buffer layer 22 is shown located between the bonding layer 20 and the second plurality of particles 18. The buffer layer 22 may be referred to as a shimming layer, padding layer, cushioning layer, wedge layer or the like. The buffer layer 22 may be made of any material, particularly including the materials listed above with respect to the bonding layer 20. In one embodiment, the buffer layer 22 and the bonding layer 20 may comprise the same material. However, in another embodiment, the buffer layer 22 and the bonding layer 20 may particularly comprise two different materials. Whatever the embodiment, the buffer layer 22 is configured to raise the second plurality of particles 18 such that the first sanding surface 12 and the second sanding surface 16 are substantially planar. While it is contemplated that the first and second sanding surfaces 12, 16 are substantially planar, it should be understood that the particles do not create a perfectly flat surface. However, it is the objective in one embodiment of the present invention that the same circular sandpaper sheet 10 will simultaneously be sanding a smooth surface that is adjacent to both the first and second sanding surfaces 12, 16. Thus, the sanding surfaces may be substantially planar.

The first and second plurality of particles 14, 18 may be attached to the respective bonding layer 20 and buffer layer 22 with any appropriate adhesive or attachment means that will be apparent to those skilled in the art. For example, glue, epoxy, paste or the like may be utilized. The surface of the bonding layer 20 and the buffer layer 22 may actually comprise an adhesive such that the particles 14, 18 may stick of adhere when they are put into contact with the surface of the bonding layer and the buffer layer 22. It should further be understood that any appropriate adhesive or attachment means may be used in order to attach the buffer layer 22 to the bonding layer.

It is also contemplated in another embodiment that one of the sanding surfaces 12, 16 may be raised very slightly in comparison to the other of the sanding surfaces 12, 16. For example, the second sanding surface 16 may protrude farther from the back surface 32 of the bonding layer 20 than the first sanding surface 12. This may be particularly advantageous in an application when the second sanding surfaces 16 is applied to a surface that has already been sanded by the first sanding surface 12. It should be understood that this very slight alteration in the amount of protrusion of the sanding surfaces from the back surface 32 of the bonding layer 20 is also applicable in embodiments having more than two grits and corresponding sanding surfaces. For example, in a three grit embodiment with three corresponding sanding surfaces, the sanding surfaces may be slightly staggered, with the finer particle sanding surface protruding further than the coarser particles. This slight variance may be one or more micrometers or one or more millimeters in scale.

Figure 3:
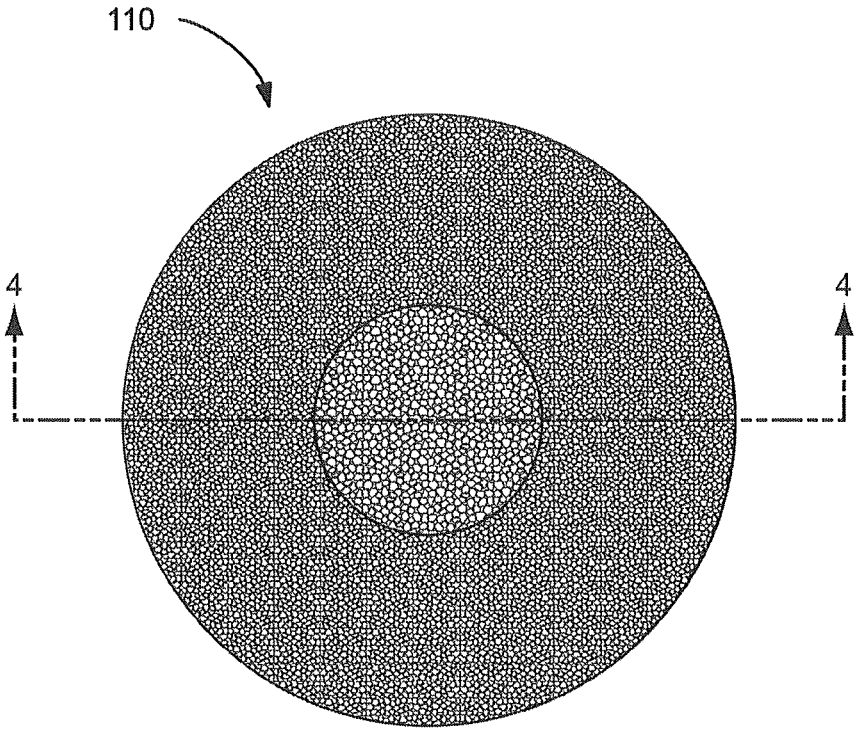
FIG. 3 depicts a top view of a circular sheet of sandpaper having a first plurality of particles and a second plurality of particles according to one embodiment of the present invention.
Figure 4:
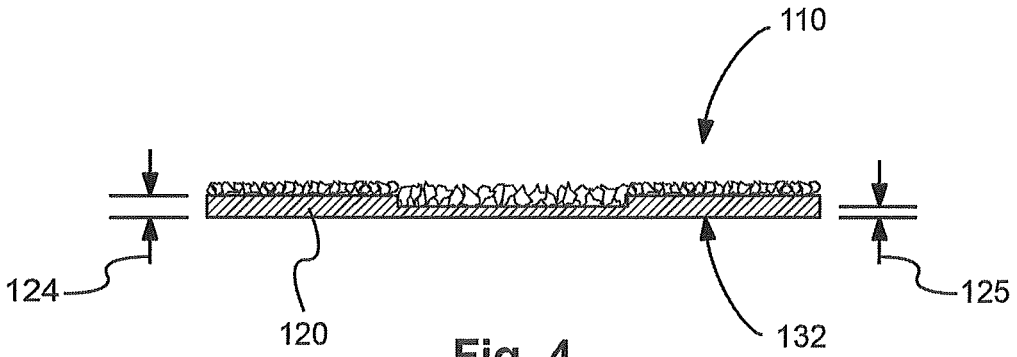
FIG. 4 depicts a cross sectional view of the circular sheet of sandpaper of FIG. 1, taken at arrows 4-4, according to one embodiment of the present invention.

Referring now to FIGS. 3-4, another embodiment of a circular sandpaper sheet 110 is shown. FIG. 3 shows a top view of the circular sandpaper sheet 110 while FIG. 4 shows a cross sectional view of the sandpaper sheet 110 taken at arrows 4-4. The circular sandpaper sheet 110 may include any or all of the features of the circular sandpaper sheet 10 described hereinabove. However, as shown in FIG. 4, the circular sandpaper sheet 110 includes a single bonding layer 120 that has two thicknesses 124, 125, and does not include a separate buffer that is distinct from the bonding layer 120. Thus, the buffer in this embodiment is simply an extended bonding layer that extends farther from a back surface 132 of the bonding layer 120 in the area upon which the finer grained particles are applied. It should be understood that any of the variations described above with respect to the circular sandpaper sheet 10 may be applied to the circular sandpaper sheet 110. For example, the circular sandpaper sheet 110 may have three or more particle sizes or grits and three or more areas located about the center of the circular sandpaper sheet 110 and noncircular dimensions are contemplated.

Figure 5:
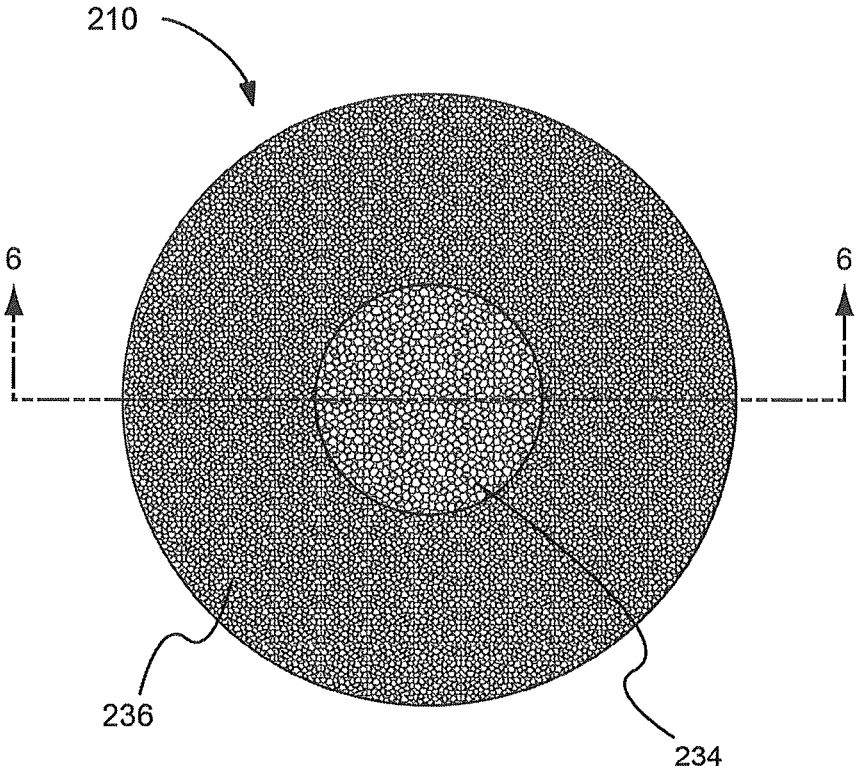
FIG. 5 depicts a top view of a circular sheet of sandpaper having a first plurality of particles and a second plurality of particles according to one embodiment of the present invention.
Figure 6:
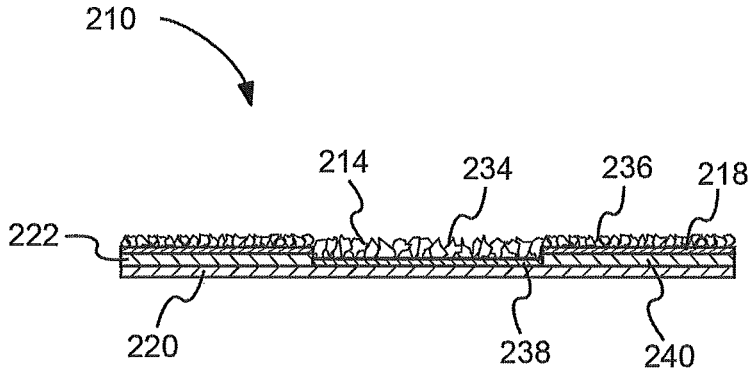
FIG. 6 depicts a cross sectional view of the circular sheet of sandpaper of FIG. 1, taken at arrows 6-6, according to one embodiment of the present invention.

Likewise, FIGS. 5-6 show a third embodiment of the present invention. Another circular sandpaper sheet 210 is shown. FIG. 5 shows a top view of the circular sandpaper sheet 210 while FIG. 6 shows a cross sectional view of the sandpaper sheet 210 taken at arrows 6-6. Like the circular sandpaper sheet 110, the circular sandpaper sheet 210 may include any or all of the features as the circular sandpaper sheet 10 described hereinabove. However, shown in FIG. 6, the circular sandpaper sheet 210 includes a first sandpaper 234 and a second sandpaper 236. The first sandpaper 234 includes a first backing 238 and a first plurality of particles 214, while the second sandpaper 236 includes a second backing 240 and a second plurality of particles 218. Thus, in this embodiment, regularly manufactured sandpaper may be integrated in a single circular sandpaper sheet 10 that utilizes a buffer, as described hereinabove with respect to either the circular sandpaper sheet 10 or the circular sandpaper sheet 110. The sandpaper 234, 236 may be integrated with any appropriate adhesive or attachment means that will be apparent to those skilled in the art. It should be understood that any of the variations described above with respect to the circular sandpaper sheet 10 and the circular sandpaper sheet 110 may be applied to the circular sandpaper sheet 210. Thus, while the circular sandpaper sheet 210 is shown having a separated bonding layer 220 and buffer layer 222, the circular sandpaper sheet 210 may also solely have a bonding layer 220 with different thicknesses depending on the grit of material to be applied.

Figure 7:
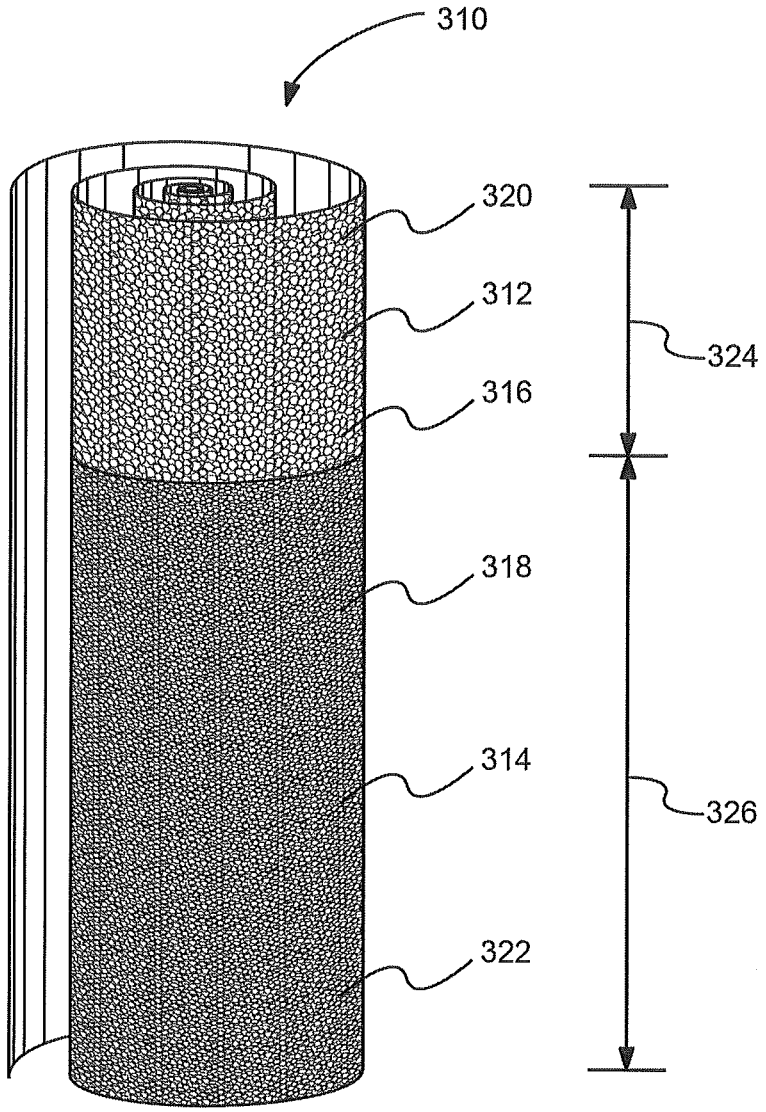
FIG. 7 depicts a roll of sandpaper according to one embodiment of the present invention.

Referring now to FIG. 7, a roll of sandpaper 310 is shown according to the present invention. The roll of sandpaper may be a 25 yard roll of sandpaper, as is commonly known in the art. Other dimensions are contemplated. The roll of sandpaper 310 may be a length of a sandpaper sheet that includes any or all of the features of the sandpaper sheets 10, 110, 210, described hereinabove. For example, the roll of sandpaper 310 may include two or more sanding surfaces 312, 314, similar to the sanding surfaces 12, 16. The first sanding surface 312 may include a first plurality of particles 316 having a first particle size and the second sanding surface 314 may include a second plurality of particles 318 having a second particle size that is smaller than the first particle size. The particle materials and grit size may be any of the materials and grit sizes described hereinabove with respect to the first and second plurality of particles 14, 18.

However, unlike the sandpaper sheets 10, 110, 210, the first and second sanding surfaces 312, 314 of the roll of sandpaper 310 may be divided along the length of the sandpaper sheet. In the embodiment shown, the first sanding surface 312 covers a first area 320 that is larger than a second area 322 that is covered by the second sanding surface 314. For example, the first area 320 may have a first width 324 of about three inches while the second area may have a second width 326 of about five inches. However, any width dimensions are contemplated. Further, while the embodiment shown may have a total width of about eight inches, this is not limiting. It should also be understood that the roll of sandpaper 310 may also be manufactured in any length. In one embodiment, for example, the roll of sandpaper 310 has a standard length of twenty five feet. Further, like the previous embodiments, the roll of sandpaper 310 may include three or more particle sizes or grits and three or more areas divided along the length. Each particle size and corresponding area may have varying width dimensions depending on the embodiment.

Figure 8:
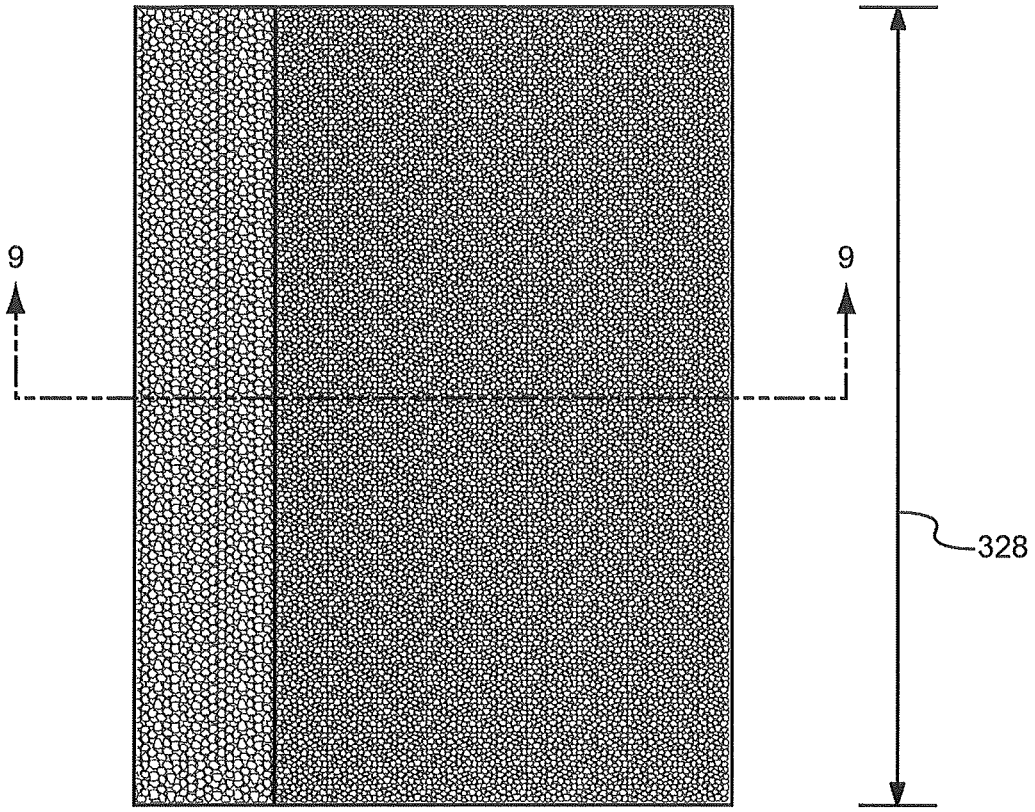
FIG. 8 depicts a top view of a sheet of sandpaper from the roll of sandpaper of FIG. 7, according to one embodiment of the present invention.
Figure 9:
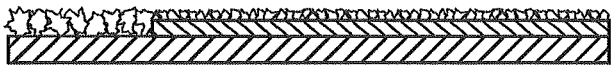
FIG. 9 depicts a cross sectional view of the sheet of sandpaper of FIG. 8, taken at arrows 9-9, according to one embodiment of the present invention.

As shown in FIGS. 8-9, a length 328 of the roll of sandpaper 310 may be cut into a sandpaper sheet 330. FIG. 8 shows a top view of the sandpaper sheet 330 while FIG. 9 shows a cross sectional view of the sandpaper sheet 330 taken at arrows 9-9. In one embodiment, the length 328 of the roll of sandpaper 310 may be of a dimension such that the sandpaper sheet 330 may be tightly wrapped around and attached to a drum of a drum sander 338 (shown in FIG. 10), as is commonly known in the art. However, the sandpaper sheet 330 may also be cut or prefabricated to any appropriate length. As shown in FIG. 9, the sandpaper sheet may include a bonding layer 334 and a buffer layer 336. The bonding layer 334 and the buffer layer 336 may be similar to the bonding layer 20 and buffer layer 22 of the circular sandpaper sheet 10. However, the bonding layer 334 may also have varying thicknesses rather than having any buffer layer, similar to the circular sandpaper sheet 110. Still further, the first and second sanding surfaces 312, 314 may comprise two standard sandpapers having a backing that is adhered or attached to the bonding layer 334 or the buffer layer 336, similar to the circular sandpaper sheet 210. Moreover, as described hereinabove with respect to the other embodiments, the roll of sandpaper 310 may also have slightly raised or lowered sanding surfaces 312, 314 in comparison to one another.

Figure 10:
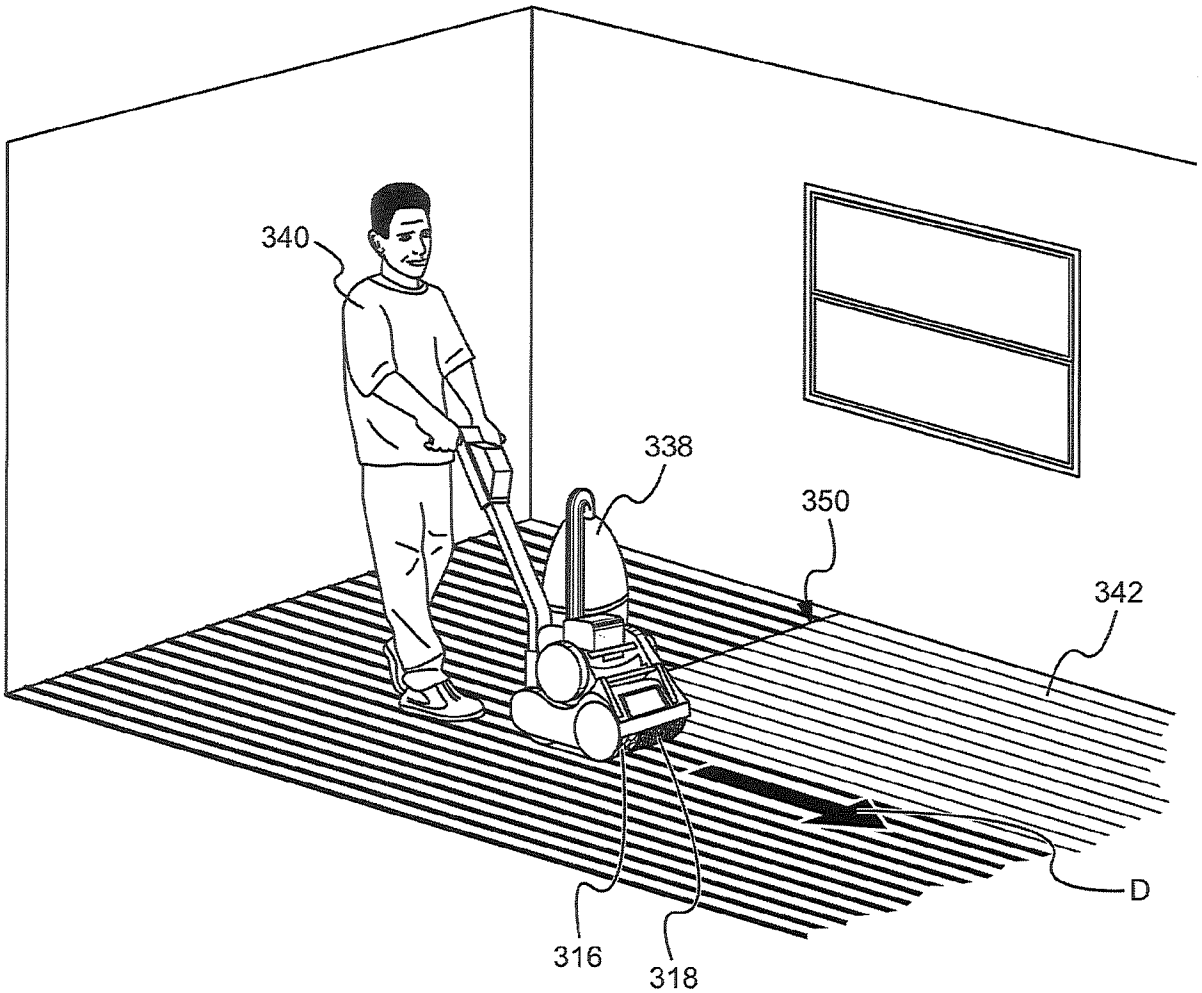
FIG. 10 depicts the sheet of sandpaper of FIGS. 8-9 attached to a drum of a drum sander according to one embodiment of the present invention.

FIG. 10 shows the sandpaper sheet 330 attached to the drum of the drum sander 338 in operation by a user 340. Depicted in the Figure is a method of sanding a floor that includes attaching the sheet of sandpaper 330 around a drum of a drum sander 338. After attachment of the sheet of sandpaper 330, the method may include rotating the drum of the drum sander 338 and the attached sandpaper 330. The method may further include moving the drum sander 338 along a floor 342 and sanding the floor 342 with the sheet of sandpaper 330 in a direction D. The method may further comprise leading the sanding of the floor with a second side 344 of the drum of the drum sander 338. In other words, the user 340 may move the sander forward in a direction 346. When the user 340 reaches the wall, the user 340 may then pull the drum sander 338 backwards without changing the orientation of the drum sander 338. The user may pull the drum sander 338 backwards until a midway point 350 is reached. Thus, the method may further comprise retaining the drum sander 338 facing substantially the same direction across a width of the floor 342 during the sanding of the floor 342. Then when the width of the floor 342 is complete, the user 340 may turn the drum sander 338 around in order to complete the opposite side of the floor 342.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. Sandpaper comprising:

a first plurality of particles having a first grain size, the first plurality of particles having a first sanding surface covering a first area of the sandpaper;

a second plurality of particles having a second grain size that is smaller than the first grain size, the second plurality of particles having a second sanding surface covering a second area of the sandpaper;

a bonding layer having a back surface located opposite the first sanding surface and second sanding surface; and a buffer positioned to raise the second plurality of particles such that the first sanding surface and the second sanding surface of the sandpaper are planar;

wherein the sandpaper is a circular sheet, the first area is an inner circle and the second area circumferentially extends from the first area such that the second area concentrically surrounds the first area.

2. The sandpaper of claim 1, wherein the buffer is a buffer layer located between the bonding surface and the second plurality of particles, and wherein the buffer layer is distinct from the bonding layer.

3. The sandpaper of claim 1, wherein the buffer is a thicker portion of the bonding layer in the second area of the sandpaper.

4. The sandpaper of claim 1, wherein the second area is larger than the first area.

5. The sandpaper of claim 1, wherein the combination of the first plurality of particles and the second plurality of particles covers the entirety of a sanding surface of the sandpaper.

6. The sandpaper of claim 1, wherein the first grain size is 40-grade particles and wherein the second grain size is 60-grade particles.

7. The sandpaper of claim 1, wherein the sandpaper is a twenty-five yard roll of sandpaper.

8. Sandpaper comprising:

a bonding layer having a bonding surface and a back surface;

a first sandpaper portion having a first grain size attached to the bonding surface of the bonding layer over a first area of the sandpaper;

a second sandpaper portion having a second grain size that is smaller than the first grain size, the second sandpaper portion located over a second area of the sandpaper; and a buffer located between the second sandpaper portion and the back surface, the buffer configured to raise the second plurality of particles such that a first sanding surface corresponding to the first sanding portion of the sandpaper and a second sanding surface corresponding to the second sanding portion of the sandpaper are at least one of substantially planar and planar;

wherein the sandpaper is circular, the first area is an inner circle and the second area circumferentially extends from the first area such that the second area circumferentially surrounds the first area.

9. The sandpaper of claim 8, wherein the buffer is a buffer layer that is distinct from the bonding portion.

10. The sandpaper of claim 8, wherein the buffer is a thicker portion of the bonding layer located in the second area of the sandpaper.

11. The sandpaper of claim 8, wherein the second area is larger than the first area.

12. The sandpaper of claim 8, wherein the combination of the first plurality of particles and the second plurality of particles covers the entirety of the sandpaper sheet.

13. The sandpaper of claim 8, wherein the first grain size is 40-grade particles and wherein the second grain size is 60-grade particles.

14. The sandpaper of claim 8, wherein the sandpaper sheet is a twenty-five yard roll of sandpaper.

15. Sandpaper comprising:

a first plurality of particles having a first grain size, the first plurality of particles having a first sanding surface covering a first area of the sandpaper;

a second plurality of particles having a second grain size that is smaller than the first grain size, the second plurality of particles having a second sanding surface covering a second area of the sandpaper; and at least one layer upon which the first and second plurality of particles are located;

wherein the at least one layer below the second plurality of particles is raised relative to the at least one layer below the first plurality of particles such that the first sanding surface and the second sanding surface of the sandpaper are co-planar;

wherein the sandpaper is circular, the first area is an inner circle and the second area circumferentially extends from the first area such that the second area circumferentially surrounds the first area.

* * * * *